US005152079A

United States Patent [19]

Goe

[11] Patent Number: 5,152,079

[45] Date of Patent: * Oct. 6, 1992

[54] METHOD AND APPARATUS FOR DRYING BRINE SHRIMP CYSTS

[76] Inventor: Simon S. Goe, No. 1 Main St., Snowville, Utah 84336

[ * ] Notice: The portion of the term of this patent subsequent to Mar. 5, 2008 has been disclaimed.

[21] Appl. No.: 589,251

[22] Filed: Sep. 28, 1990

Related U.S. Application Data

[63] Continuation-in-part of Ser. No. 183,143, Apr. 19, 1988.

[51] Int. Cl.[5] ..... F26B 11/02

[52] U.S. Cl. ..... 34/130; 34/140

[58] Field of Search ..... 34/130, 131, 132, 133, 34/134, 135, 58, 140, 141

[56] References Cited

U.S. PATENT DOCUMENTS 1,664,098 3/1928 Yates ..... 34/130

*Primary Examiner*—Henry Bennett

*Attorney, Agent, or Firm*—A. Ray Osburn

[57] ABSTRACT

A method, and associated apparatus, for drying harvested brine shrimp cysts for storage for subsequent hatching for fish food. The cysts are washed with fresh water, and strained through a sieve to remove foreign material, flotation separated to eliminate dead cysts, strained out of the water, dewatered centrifugally, and finally dried in a special apparatus which prevents any caking of the cysts together. The drying apparatus includes a drum with cyst-retaining porous walls, mounted on its side to rotate in a vented housing about its longitudinal axis. Drying air is blown into the rotating drum, exiting through the porous walls, drying the cysts without caking.

17 Claims, 10 Drawing Sheets

METHOD AND APPARATUS FOR DRYING BRINE SHRIMP CYSTS

RELATED APPLICATIONS

This application is a continuation-in-part of a divisional application of the same titled filed simultaneously herewith based upon co-pending application Ser. No. 07/183,143, filed Apr. 19, 1988, entitled METHOD AND APPARATUS FOR DRYING BRINE SHRIMP CYSTS, Inventor: Simon Soul-Sun Goe.

BACKGROUND OF THE INVENTION

1. Field

The field of the invention is apparatus and methods for preparation of the cysts of the brine shrimp (Artemia spp.) to be containerized for storage, shipment and later hatching into nauplii for use as fish food.

2. State of the Art

Developing brine shrimp are in nature contained within protective spherical cysts. The cysts are found floating in the dense concentrated brine, for example, of the Great Salt Lake, Utah, and are harvested by seining and bagging. As originally harvested, the bagged cysts are accompanied by various lake and shore detritus and flotsam, as well as water and salt, and must be washed and seived with fresh water to remove the salt and debris. Since whole, viable cysts will not float in fresh water, as will broken dead cysts, settling and skimming may be employed to dispose of the latter. The water is then drained off through a fine mesh seive which retains the viable cysts. The cysts may then be bagged and further dewatered in a centrifugal spin tank.

After dewatering, the cysts must be further dried before being placed in sealed cans for storage and shipment. Heretofore, the damp mass of cysts has been spread in thin layers in trays and allowed to dry. Both atmospheric and oven drying environments have been utilized. Periodic manual stirring of the mass of cysts is sometimes used. With these procedures, individual cysts become caked together into a crumbly aggregate. However, the cysts must somehow later be separated before hatching, or the cake at least crumbled to reasonably small clumps of aggregated cysts. This breaks and destroys substantial numbers of the cysts. There is therefore a definite need for a method of brine shrimp cyst preparation for canning which is more efficient in terms of surviving cysts.

BRIEF SUMMARY OF THE INVENTION

With the foregoing in mind, the present invention eliminates or substantially alleviates the disadvantages and shortcomings in the prior art of shrimp cyst preparation for canning. Harvested cysts are first washed and sieved with fresh water to remove foreign matter, then dewatered by gravity draining and centrifugal extraction. The clean but still quite wet and soggy cysts are then dried in a special apparatus, which produces loose, separately dried, uncaked cysts ready for placement into cans.

The apparatus comprises a rotatable elongate drum mounted so that its longitudinal axis is horizontal. A stream of warm drying air is introduced into the interior of the rotating drum, to exit through a fine mesh screen comprising a portion of the wall of the drum. The screen retains the cysts while permitting air passage. Preferably, a stationary air inlet tube is provided, mounted in sealed relationship to the rotating drum, facilitating the connection of a flexible warmed air supply duct. The rotating drum constantly raises and drops the cysts through the drying air in the space within the drum, maintaining the individual cysts in constantly relative motion. This prevents the cysts from cementing together as happens with other drying methods. Preferably, the oven further comprises a stationary housing about the drum, with exit vents for moisture-laden used drying air. Preferably, the housing is mounted to be tilted from the horizontal to facilitate loading and unloading of the cysts.

In one preferred embodiment, a hinged door provides interior access to the drum at one of its ends, with the flexible air duct joined to a rigid air inlet tube which is mounted rotatably sealed through the door. In another such embodiment, a similar rigid air inlet tube attached to the flexible duct is telescoped stationary within a larger diameter tube permanently secured coaxially with the drum through one of its ends. No rotating seal is required with this design, since the incoming air stream aspirates a small amount of ambient air inwardly into the drum, preventing the escape of any cysts. In this embodiment, the drum is preferably cradled at its ends upon rollers. Rotation power may be applied to one or more of the rollers, which in turn rotates the drum. A chain and sprocket arrangement with an electric motor may be used to power the rollers. In this embodiment, the access door comprises a simple, clamp retained lightweight panel at the remaining end of the drum.

It is therefore the object of the invention to provide an improved method and associated apparatus for preparing brine shrimp cysts for canning, and to minimize damage to the cysts and increase the yield of viable cysts in the finished product.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
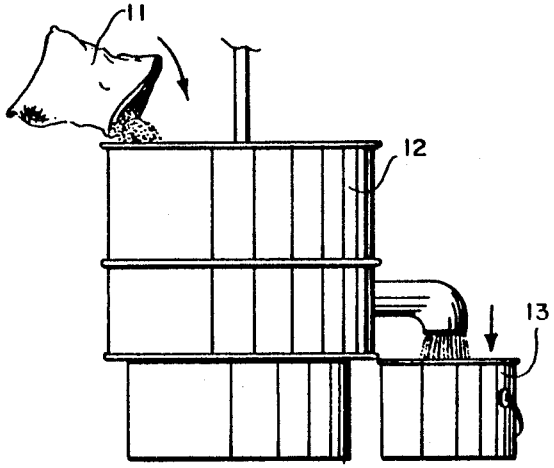
FIG. 1 is an elevational view of a washing and screening tank being used to screen out foreign matter from the harvested shrimp cysts, the mixture of water and cysts passing the screen shown being deposited into a settling container, drawn to a reduced scale, FIG. 2 the settling container of FIG. 1 shown in use, the broken cysts being seined from the top thereof and the sound cysts settling to the bottom thereof, drawn to a larger scale than FIG. 1, FIG. 3 the fine mesh cyst net being shown in operation, straining the cysts from the mixture of water and cysts remaining after the settling illustrated in FIG. 2, drawn to a larger scale than FIG. 1, FIG. 4 an elevational view of a centrifugal water extraction apparatus, cotton bags of cysts as retained by the net of FIG. 3 shown being placed therein, drawn to approximately the scale of FIG. 1, FIG. 5 the centrifugal device of FIG. 4 illustrated extracting water from the bagged cysts, partially cut away, drawn to the scale of FIG. 4, FIG. 6 a side elevational view of a shrimp cyst drier in accordance with the invention, a bag of cysts from the centrifugal extractor of FIG. 5 shown being placed thereinto for drying, said drier being tilted to facilitate loading, drawn to a reduced scale, FIG. 7 the drier of FIG. 6 during operation, being returned to level to evenly distribute the cysts therein, drawn to the scale of FIG. 6, FIG. 8 the drier of FIG. 7 shown being emptied of dried cysts, tilted to facilitate the cyst removal, drawn to the scale of FIG. 6, FIG. 9 a side elevational view of a shrimp cyst drier in accordance with the invention, shown connected to a drying air supply duct, drawn to a reduced scale larger than that of FIG. 6, FIG. 10 a vertical sectional view of the drier of FIG. 9, taken through the longitudinal axis of the drum thereof, drawn to the same scale, FIG. 11 a front elevational view of a fragment of the drier of FIG. 9, taken along line 11—11 thereof, drawn to the same scale, FIG. 12 a rear elevational view of a fragment of the drier of FIG. 9, taken along line 12—12 thereof, partially cut away to show the drive chain and sprocket, drawn to the same scale, FIG. 13 an enlarged view of a fragment of the drier of FIG. 10, FIG. 14 an enlarged view of another fragment of the drier of FIG. 10, drawn to the same scale as FIG. 13, FIG. 15 a vertical cross sectional view of the drum of the drier of FIG. 10, taken along line 15—15 thereof, indicating the stirring of the cysts during drying and the flowing of air through the drum, drawn to the scale of FIG. 10.
Figure 2:
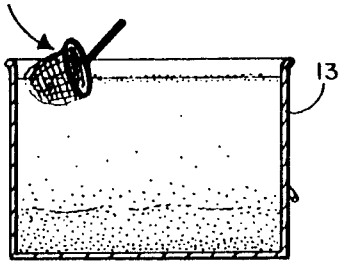
Figure 3:
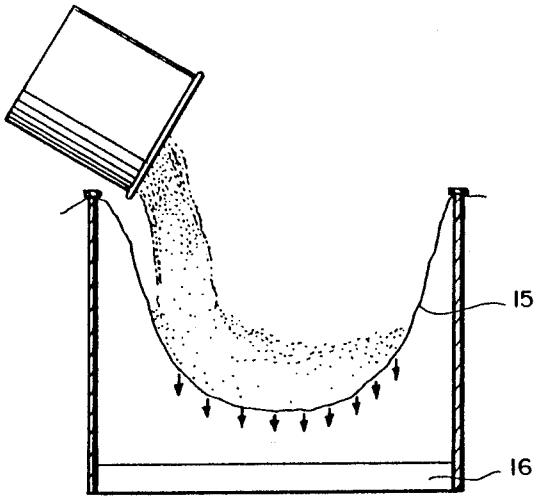
Figure 4:
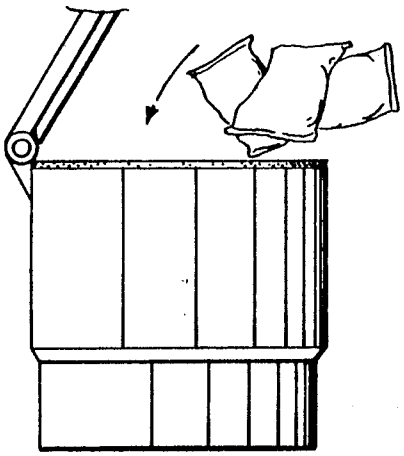
Figure 5:
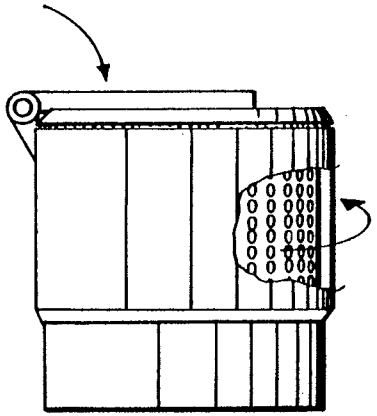

The inventive method and apparatus 10 for processing brine shrimp cysts is illustrated in the drawings. The viable cysts, seined from their natural habitat and delivered in plastic, water-permeable bags 11 for processing, must first be freed of foreign materials and damaged cysts. The necessary preliminary cleaning and washing steps are illustrated in FIGS. 1-5. The cysts are first mixed with fresh water and passed through a vibrating mesh screen, not shown, in a screening tank 12 to remove the larger sized foreign objects. The mixture of water and cysts which passes through the debri screen is then placed in a settling container 13. Any damaged broken cysts rise to the top of the fresh water, to be removed with a debri net 14. The sound viable cysts settle in the fresh water to the bottom of container 13. The water/cyst mixture can then be dewatered by pouring it into a cyst strainer, 120-mesh, net 15, which retains the cysts and allows the water to drain into a pan 16. The retained cysts are scooped from net 15 into cotton bags 17, which are placed into a centrifugal spinning device 18 to further dewater the cysts.

Figure 7:
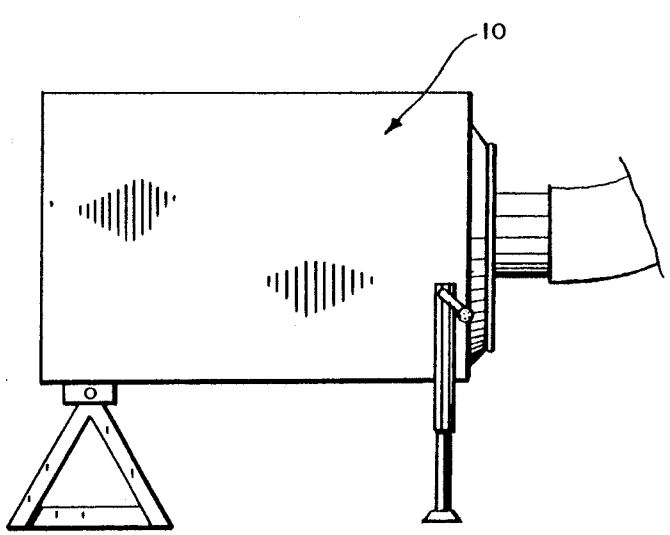
Figure 6:
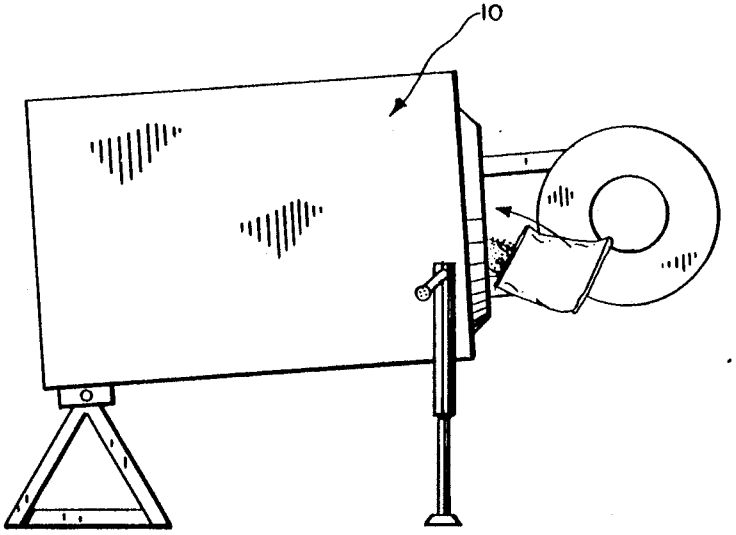

After spinning, the cysts are still quite damp, but are ready for final drying, the most critical step in preparation for canning. As previously discussed, with prior art final drying methods the cysts cake together resulting in eventual fatal damage to many cysts. To prevent this caking, final drying apparatus 10 is provided, illustrated in use in FIGS. 6-8 and in detail in FIGS. 9-16.

Figure 9:
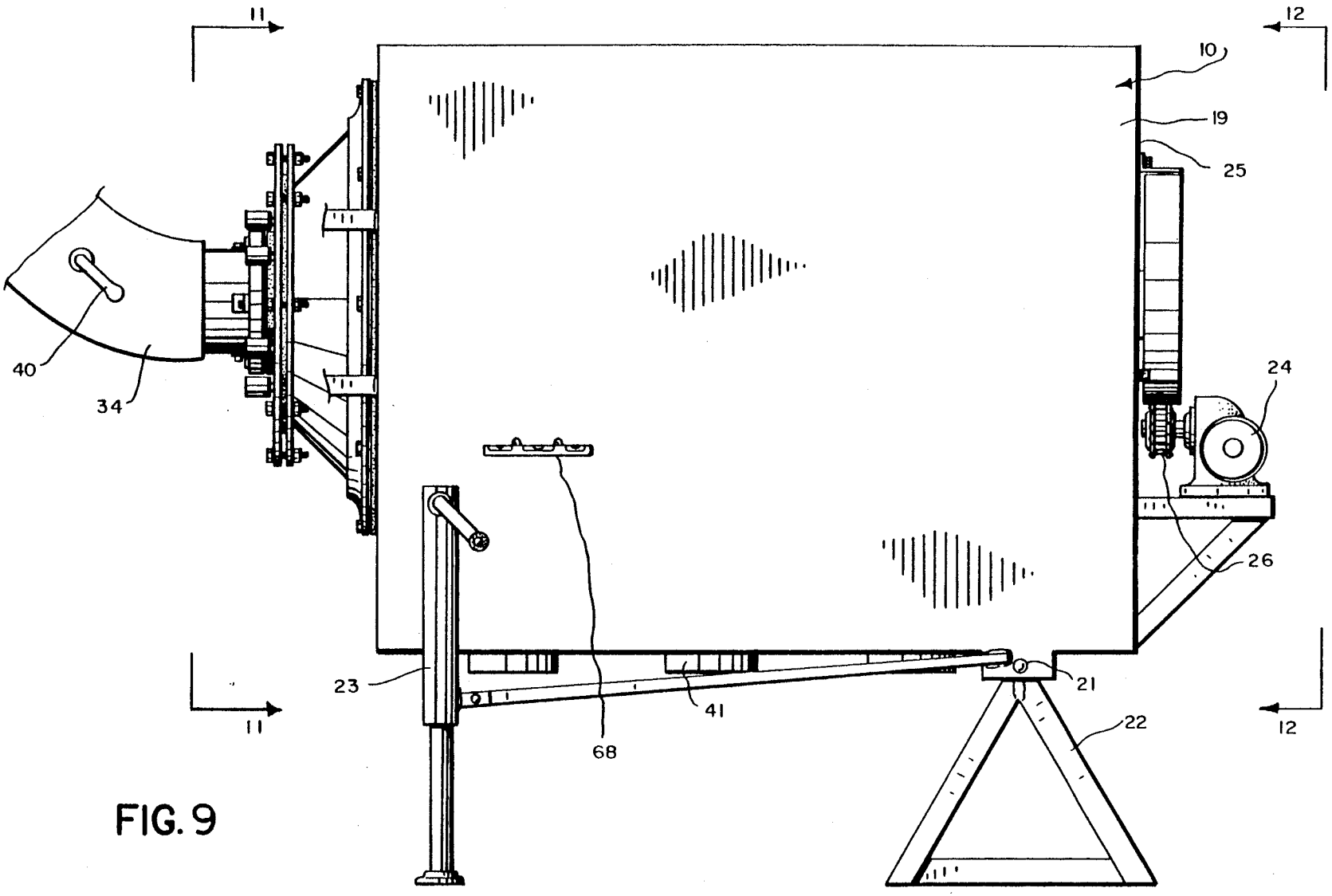
Figure 10:
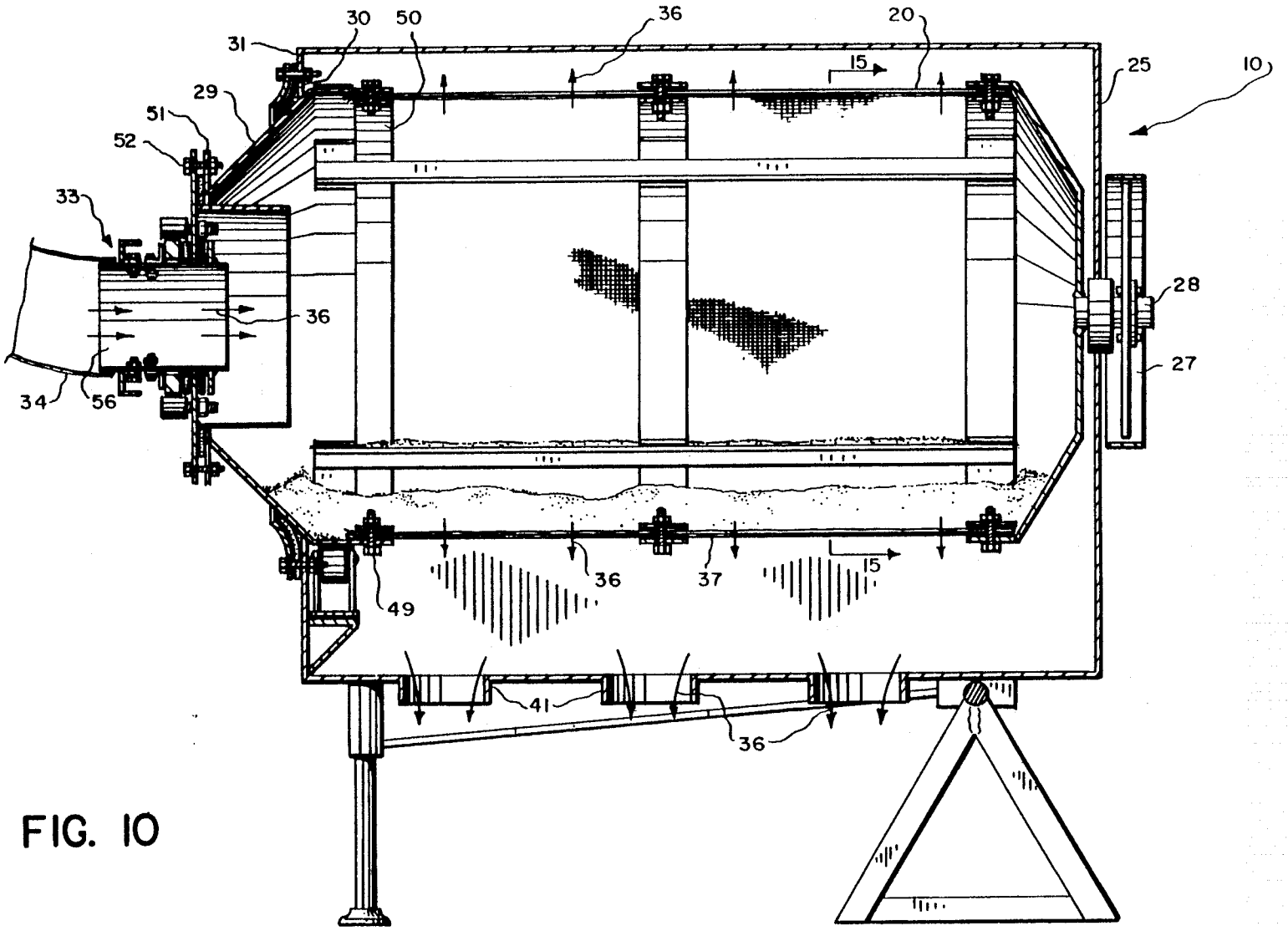
Figure 12:
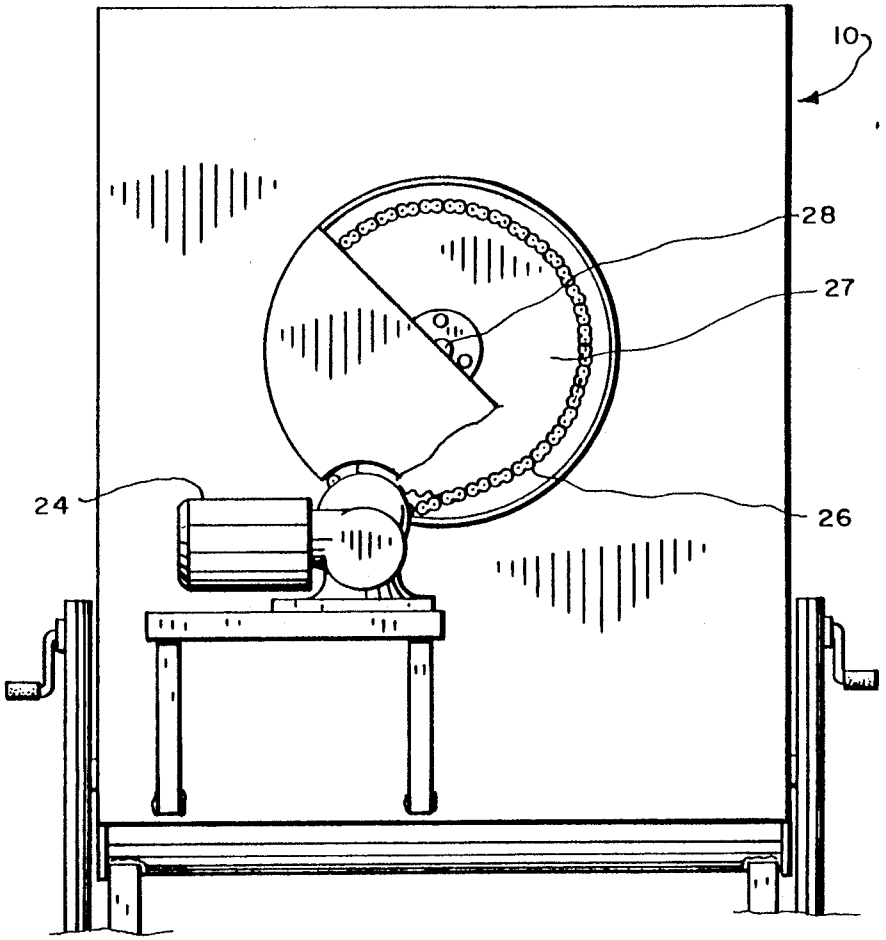
Figure 11:
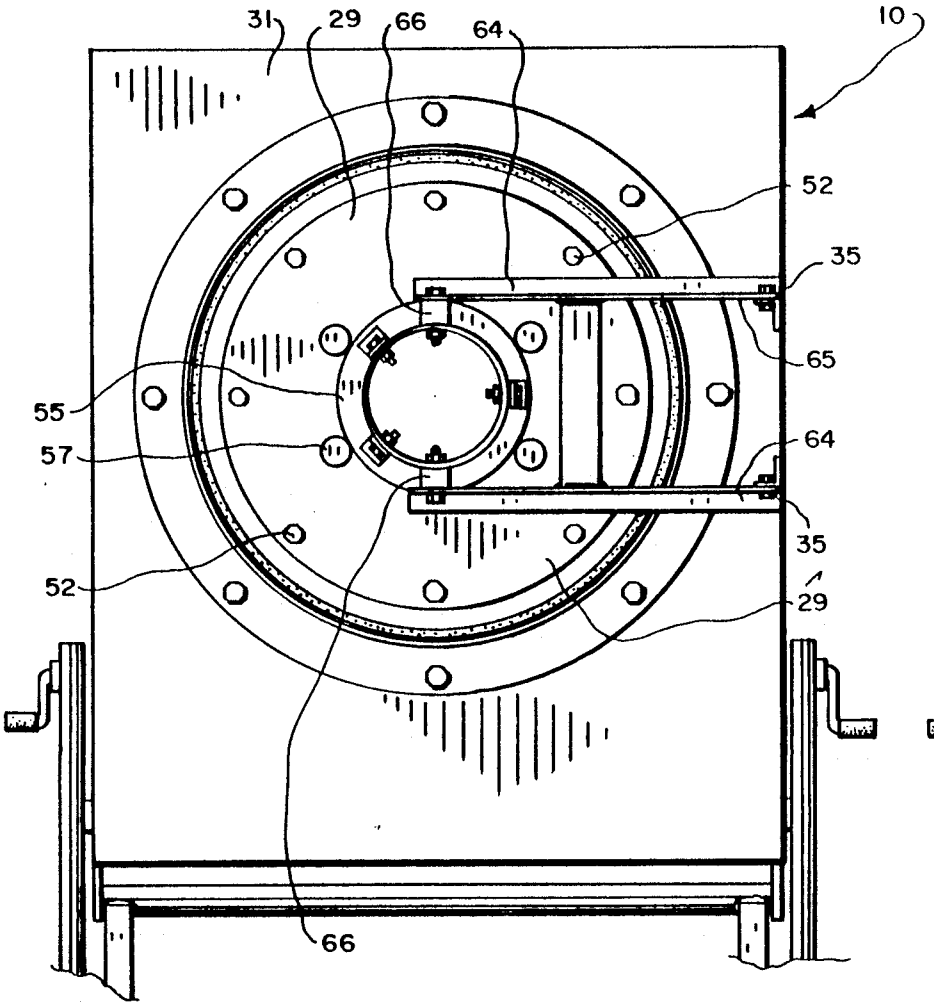
Figure 15:
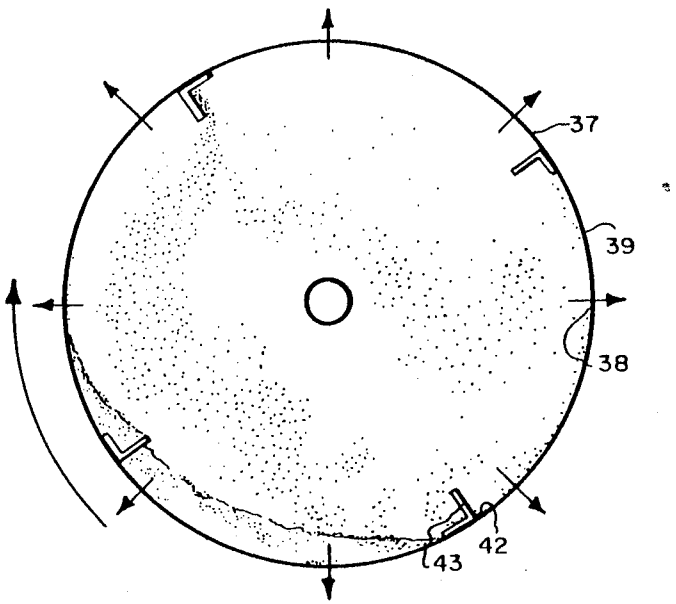
Figure 16:
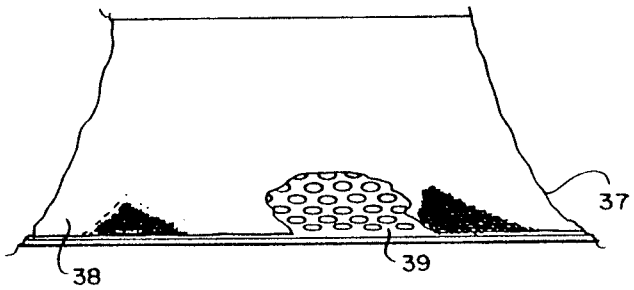
FIG. 16 a front perspective view of a fragment of the cylindrical wall of the drum of FIG. 10, showing the perforated cylindrical backing member and the covering fine mesh screen, drawn to a larger scale than FIG. 10.

Drier 10 comprises a stationary exterior housing 19 and an interior drum 20 mounted rotatably therein. (FIGS. 9 and 10) Housing 19 is supported at its rearward end by transverse horizontal pivots 21 upon an angle iron triangular support 22, and at its forward end upon a pair of adjustable legs, such as the jacks 23. A motor 24, bracketed to rear wall 25 of housing 19, acts through a chain 26, sprocket 27, and drive shaft 28 to rotate drum 20. (FIGS. 10 and 12)

Figure 13:
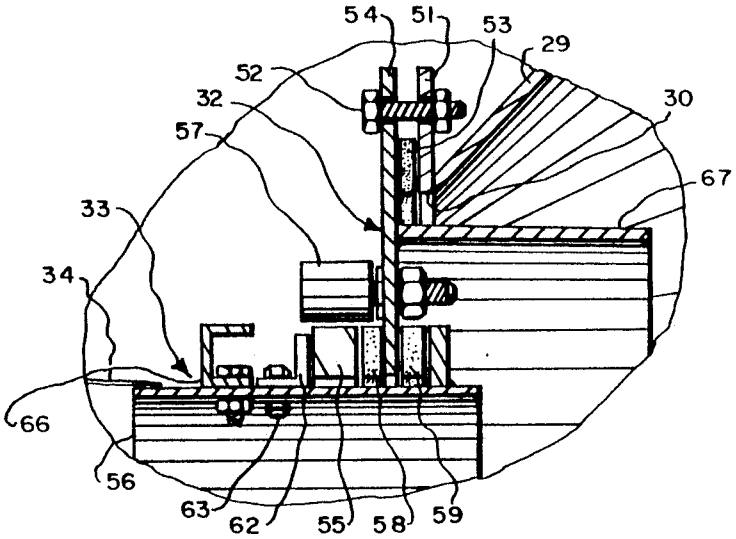
Figure 14:
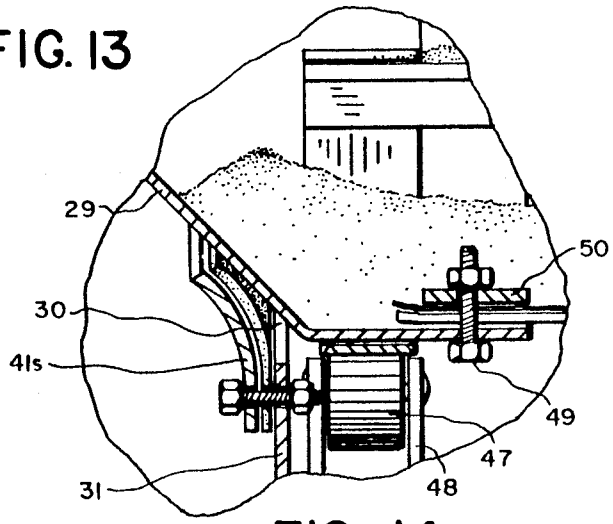

Conical front end closure 29 of drum 20 protrudes through circular hole 30 in housing front wall 31. (FIGS. 10, 11 and 14) Protruding drum closure 29 carries a hinged access door assembly 32. Air inlet assembly 33 on door 32 connects to a flexible warm air supply duct 34. (FIGS. 9, 10 and 13)

The dewatered but damp cysts are emptied from cotton bags 17 into the interior of drum 20. Access door assembly 32 is then pivoted closed about hinges 35. (FIGS. 6 and 7) Warmed air (arrows 36) is then allowed to flow from air supply duct 34 through air inlet 33 into the interior of drum 20, which is now rotated by motor 24 through chain 26 and sprocket 27. The drying air 36 flows out of drum 20 through cylindrical drum wall 37. Wall 37 comprises a fine mesh screen 38 supported on its outer side by a perforated metal cylinder 39. (FIGS. 10, 15 and 16) Being of 120 mesh, screen 33 retains individual cysts. Very little pressure is required in drum 20 because of the large exposed area of screen 38. The flow of incoming air may be controlled by damper 40 on supply duct 34. Vents 41 through housing bottom wall 42 assure circulation of the light weight warm air throughout the interior of housing 19 around drum 20. A flexible seal 41s, bolted to housing front wall 31, prevents air leakage through opening 30 around cone 29.

As drum 20 turns, the mass of cysts tends to follow wall 37 because of shearing friction with screen 38, but falls away when raised sufficiently. (FIG. 15) Protruding legs 43 of longitudinal drum stiffening angles 44 also help to raise the cysts to fall through the free air space inside drum 20. (FIG. 15) The drying air, forced to exit through the entire surface of cylindrical wall 37, is directed to flow throughout the interior of drum 20. The still damp cysts are thus evenly exposed to the flow of drying air. The drying process however includes heating the cysts by conduction from the drum walls, inducing evaporation of moisture which is then carried from drum 20 by the flow of air 36. The constant stirring from drum rotation assures even heating of the mass of cysts.

Because the individual cysts are never permitted to be in sustained stationary contact, no cementitious adherence (caking) of the cysts together can occur. Each individual cyst is thus equally and individually dried, remains completely separated, and exists unconnected and autonomous. Very few of the cysts are broken, since no forceable separation is employed as with other drying methods. The recovery factor in terms of intact viable cysts is therefore very high.

To prevent loss of the 245 micron diameter cysts to the atmosphere, drum 20 is provided with rotating seals. At the rear housing wall 25, blind hub 45 accepts the end of drive shaft 28, precluding any need for a rotating seal. Such a seal must however be provided at the front end of drum 20, as described below.

At its front end, drum 20 rides through race collar 46 upon a pair of bearing wheels 47 mounted upon brackets 48 on front wall 31 of housing 19. (FIGS. 10 and 14) Conical end closure 29 of drum 20 is secured by bolts 49 acting through inside collar 50, to the front end of drum cylindrical wall 37. A flange 51 is welded to the small end of cone 29, to which bolts 52 secure access door assembly 32 sealed by an annular gasket 53.

Access door assembly 32 comprises annular main door plate 54 and air inlet assembly 33. During operation of drier 10, main plate 54 rotates with end cone 29 and drum 20. Air inlet assembly 33 remains stationary, supported through raceway 55 around tube 56 upon several rotating bearings 57, which are circularly placed on door plate 54. (FIGS. 10, 11 and 13) Air and cyst leakage about tube 56 is prevented by tube gaskets 58 and 59, which press elastically against the tube exterior surface. Sealing contact between elastic gaskets 59 and 58 and door plate 54 is maintained by tube flange 61 and raceway 55 respectively. Raceway 55 is retained by circularly formed angle flange 62, removable from tube 56 by bolts 63. Gaskets 59 and 60 are preferably of highly lubricous material, such as Teflon.

Members 64 of hinge frame 65 are bolted to channels 66 in turn bolted to tube 56. (FIGS. 11 and 13) Frame 65 is connected through hinges 35 to housing front wall 31.

To open door assembly 32, bolts 52 are removed to free plate 54 from flange 51. Door 32, along with inlet tube 33, is rotated about hinges 35, freeing end opening 67 for drum access.

A cyst deflection shield 68 is welded to door plate 54 to prevent accumulation of cysts in the area of rotating seals 58 and 59. (FIG. 13) Shield 68 may be tapered to prevent accumulation of cysts upon its upper surface.

Figure 8:
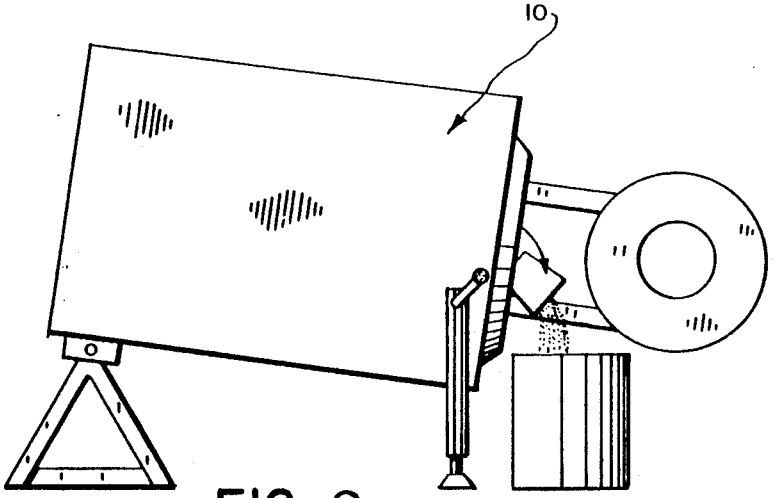

The pivotal mounting of housing 19 facilitates both the loading and unloading of drum 20. For loading, housing 19 is tilted by jacks 33 to raise its front end, providing an internal slope causing the cysts to vibrate rearwardly from drum end opening 67. (FIG. 6) After being loaded, housing 19 is returned to horizontal to evenly distribute the cysts during the drying cycle. Spirit levels 68 are provided on the sides of housing 19. (FIG. 7) To remove dried cysts, the jacks are lowered causing the cysts to flow forwardly, to be easily scooped out into buckets. (FIG. 8)

Figure 17:
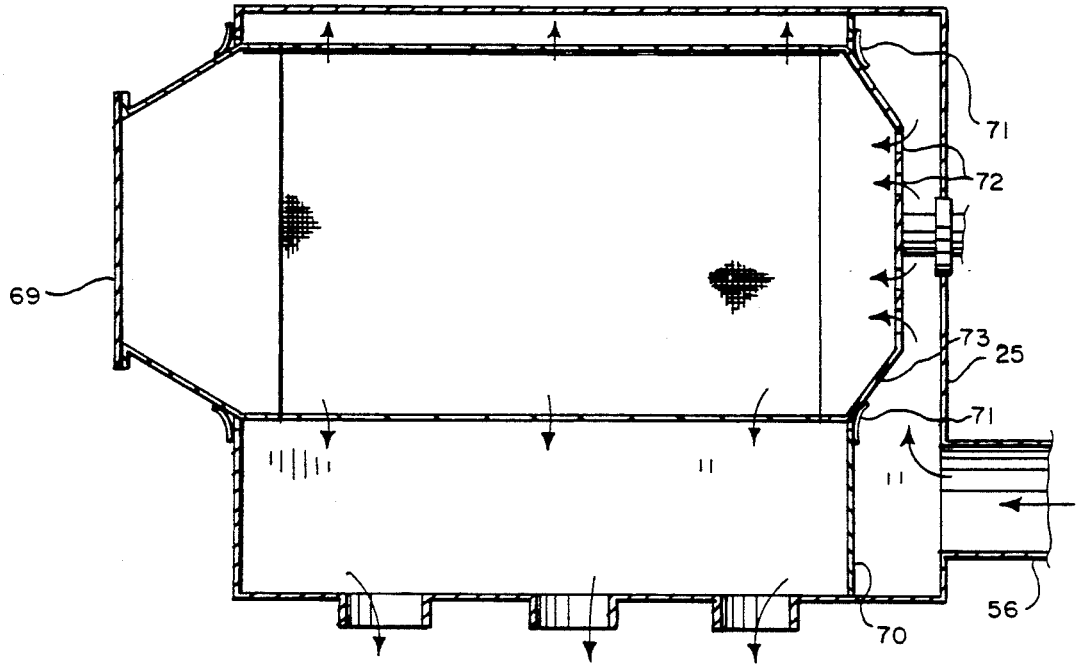
FIG. 17 a representation of another preferred embodiment of a drier in accordance with the invention, drawn to a reduced scale, FIG. 18 a representation of still another preferred embodiment of a dryer in accordance with the invention, drawn to the scale of FIG. 17, FIG. 19 a vertical sectional view of another preferred embodiment of a dryer in accordance with the invention, wherein the drying air is introduced through an aspirating arrangement and the drum is powered through rollers upon which it is cradled, drawn to the scale of FIG. 10, along line 19—19, FIG. 21, FIG. 20 an end elevation view of the dryer of FIG. 19, taken along line 20—20 thereof, drawn to the same scale, FIG. 21 a rear end elevation view of the dryer of FIG. 19, taken along line 21—21 thereof drawn to the same scale FIG. 22 a side elevation view of one of the door plate retaining clamps of the dryer of FIG. 20, taken along line 22—22 thereof, drawn to substantially full scale, FIG. 23 a plan view of a fragment of the powering motor and sprocket arrangement powering the rollers of the dryer of FIG. 20, taken along line 23—23 of FIG. 21, drawn to the same scale, FIG. 24 an elevation view of a fragment of the dryer of FIG. 19 showing the aspirating arrangement of tubes, however with a rotating seal provided therebetween, drawn to the scale of FIG. 19, and FIG. 25 a sectional view of a fragment of an air inlet tube arrangement wherein rotating seals are provided with a single air inlet supply tube through the rear closure of the dryer, drawn to the scale of FIG. 13.
Figure 18:
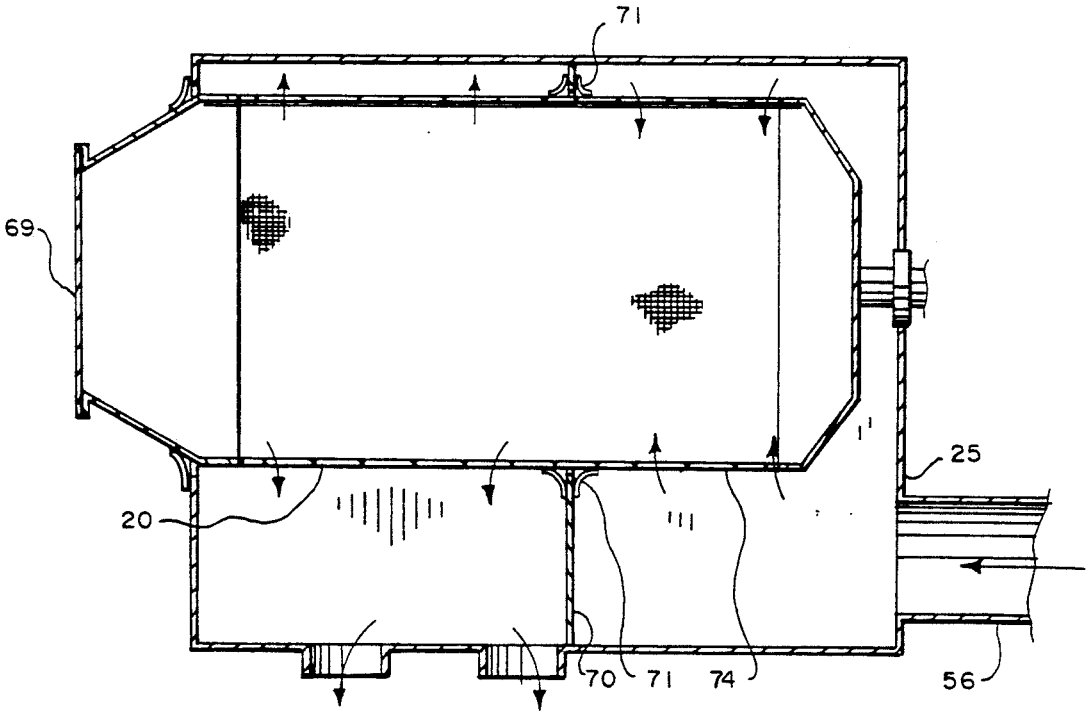
Figure 19:
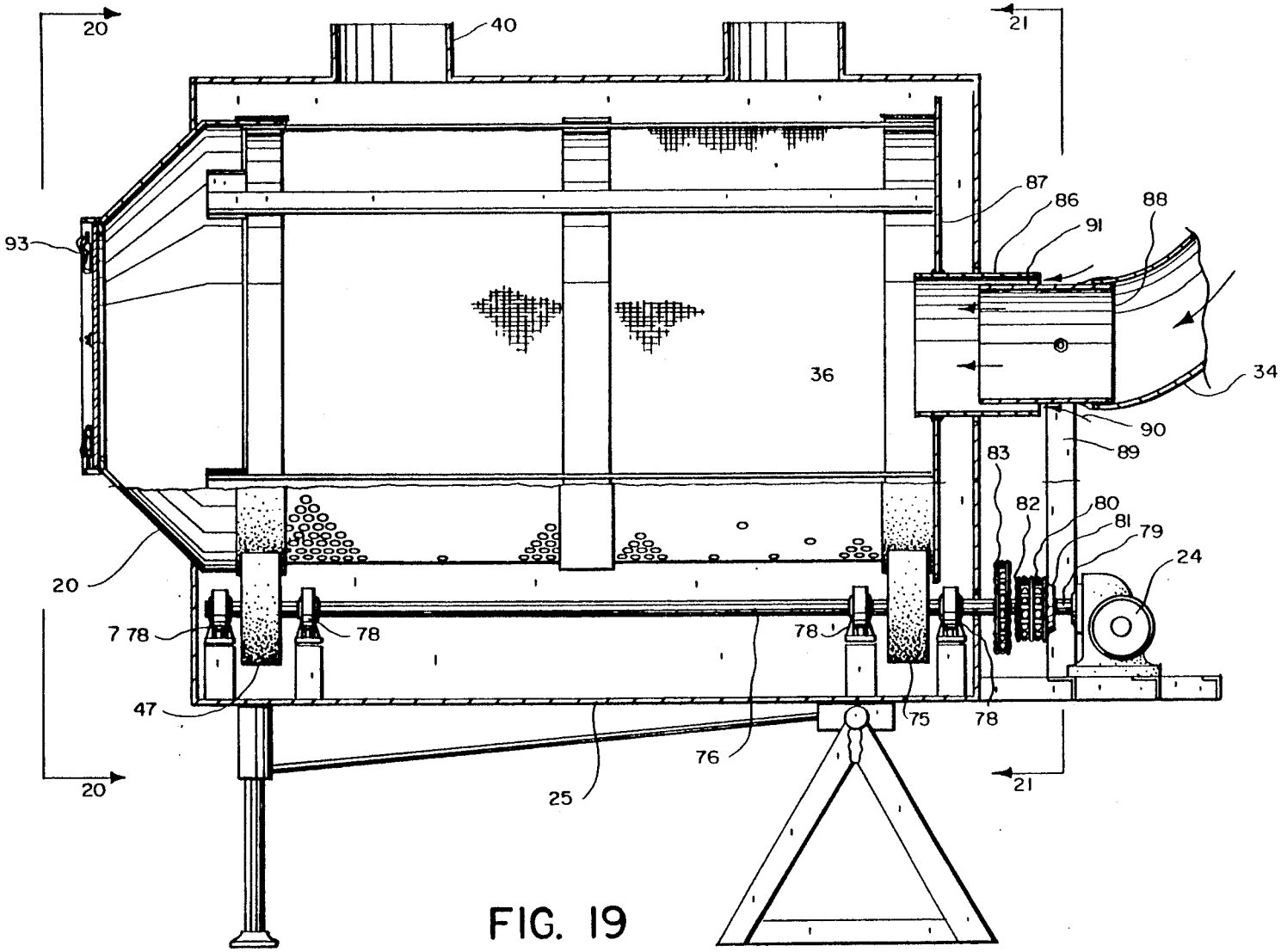
Figure 21:
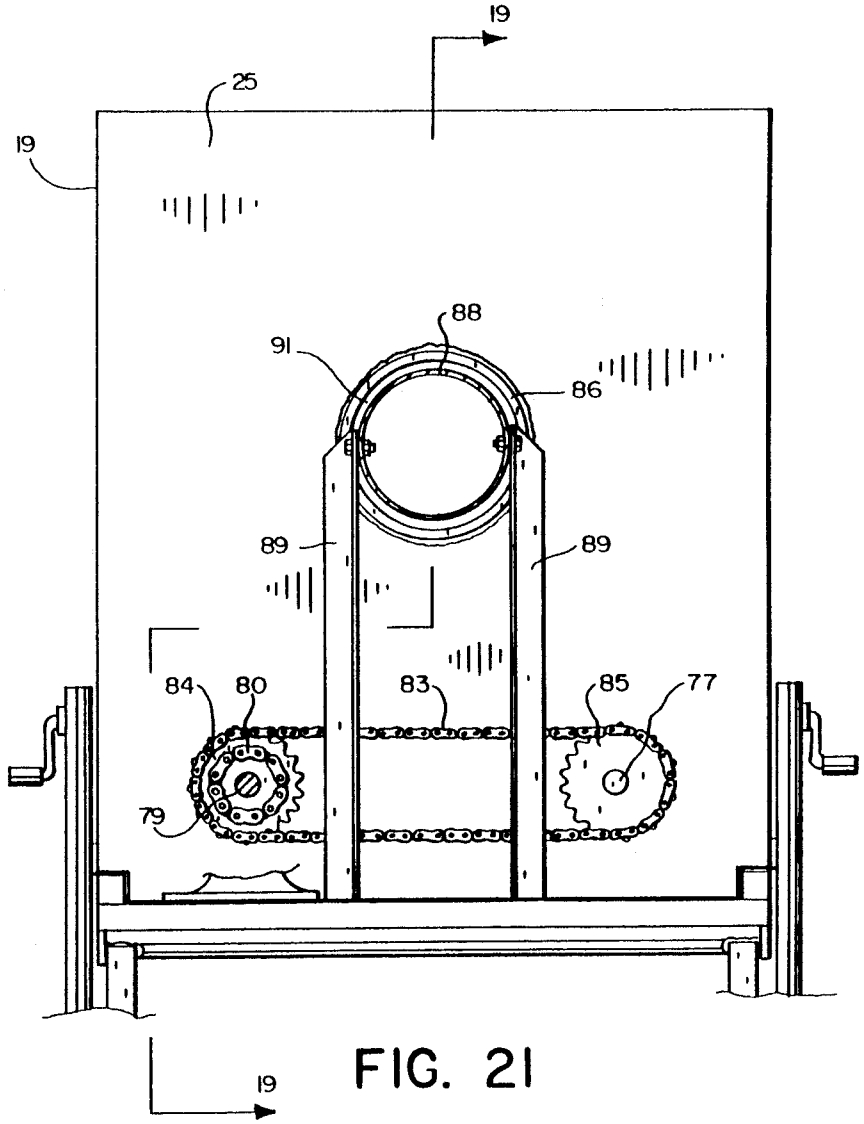
Figure 20:
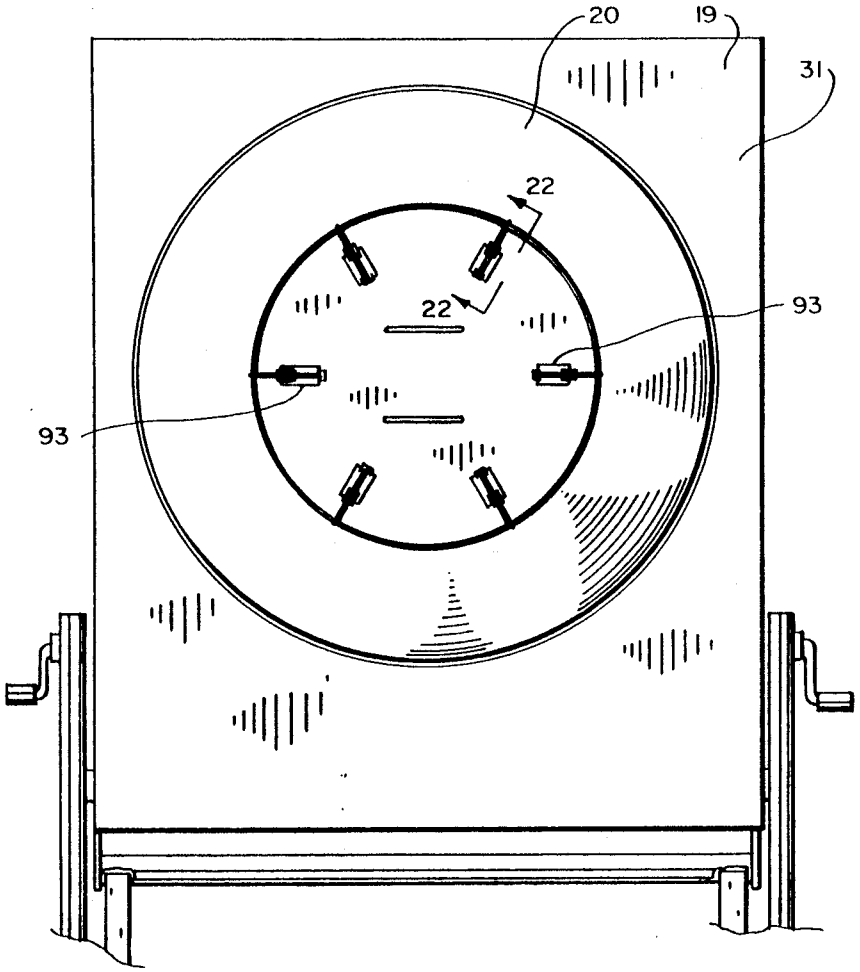

The spirit of the invention encompasses variations from the embodiment described herein. For example, the problem of cyst loss from the rotating drum could be solved not by the door assembly illustrated, but by providing a rotating seal, not shown, between the end of the duct 34 and the tube 56. Or, door assembly 32 could be replaced with a circular plate 69, and air inlet tube 56 placed instead on rear housing wall 25. (FIG. 17) Housing partition 70 with seal 71 is added to direct the air into drum 20 through inlet orifices 72 in rear drum closure 73. In another variation (FIGS. 18) the air could even enter into drum 20 through the portion 74 of screen 38 rearward of partition 70. Although drying would be much less efficient, cake free dried cysts could even be produced without housing 25. The tilt mounting arrangement, although very advantageous, is not essential to production of such dried cysts. And, other means of rotating drum 20 would conform also to the spirit of the invention.

One such other drum rotating means is employed in a preferred embodiment of the brine shrimp cyst drying apparatus 10 illustrated in FIGS. 19–23. In this embodiment, drum 20 is supported upon the pair of rollers 47 at its front end and also upon an additional pair of rollers 75 at its opposite, rearward end. Drum rotating power is delivered through a pair of drive shafts 76 and 77, to each of which one of the rollers 75 and 47 is irrotatably affixed. The shafts are supported upon the housing 25 by paired sets of bearing blocks 78. Electric motor 24 is coupled through its output shaft 79 to the drive shaft 76 through a coupling chain 80 spanning between a motor shaft coupling sprocket 81 and a drum shaft coupling sprocket 82. The drum drive shafts are themselves connected by a chain 83 acting on sprockets 84 and 85, so that drum 20 is rotated by all of the four rollers.

With the above described method of rotating drum 20, its rear end closure may be utilized for introduction of the cyst drying air into drum 20. Preferably, an air inlet tube 86 is provided, coaxial with drum 20 and rigidly secured through drum end closure 87.

Inserted into air inlet tube 86 is a drying air supply tube 88, connected to air supply duct 34. Tube 88 is stationary, supported by a frame 89. With this arrangement, the velocity energy of the incoming drying air aspirates some ambient air (arrow 90) into drum 20 through annular opening 91 between tubes 88 and 86. This effectively prevents the loss of any airborne cysts at this location.

Figure 22:
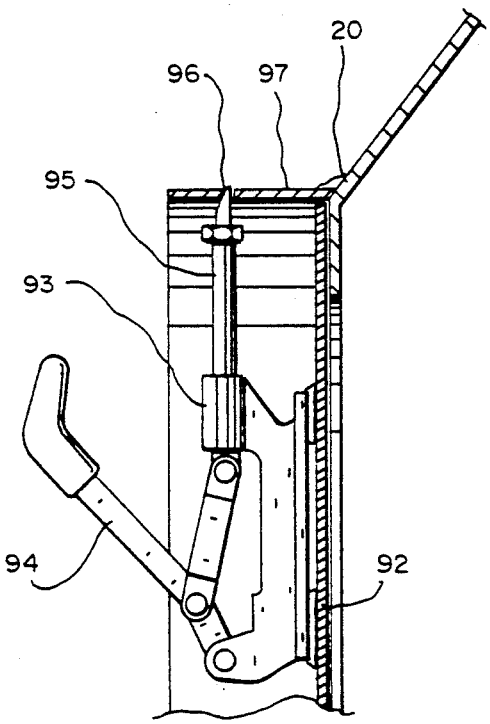

With this embodiment, access to the interior of drum 20 may be provided by a simple closure plate 92 at the opposite end of drum 20, secured by circumferentially spaced clamps 93. Clamps 93 comprise a lever 94 by which a pin 95 is inserted through attachment holes 96 in a short cylindrical skirt 97 affixed to drum 20. A thin circumferential gasket 98 may be provided if necessary to prevent cyst loss. (FIG. 22)

This embodiment of apparatus 10 eliminates need for rotating seals to avoid loss of cysts from the drum during drying. As with previously illustrated embodiments, the rotating drum may be mounted within a housing 19 provided with outlet vents 40 for the drying air emerging from drum 20. Drum-to-housing seals 41s or the like (FIG. 14) have proven unnecessary. In fact, the housing effect, if any, upon the drying process and results has not been detected. It may be desirable to direct the drying air variously to dispose of it in particular installations, but to do so seems not to effect the operation of drying apparatus 10. In fact, drying apparatus 10, without any housing, is capable of unimpaired drying of the cysts.

Figure 24:
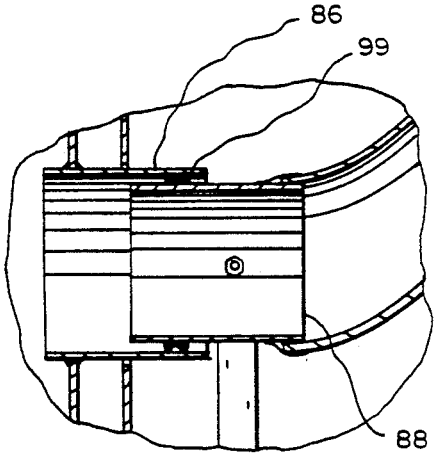
Figure 25:
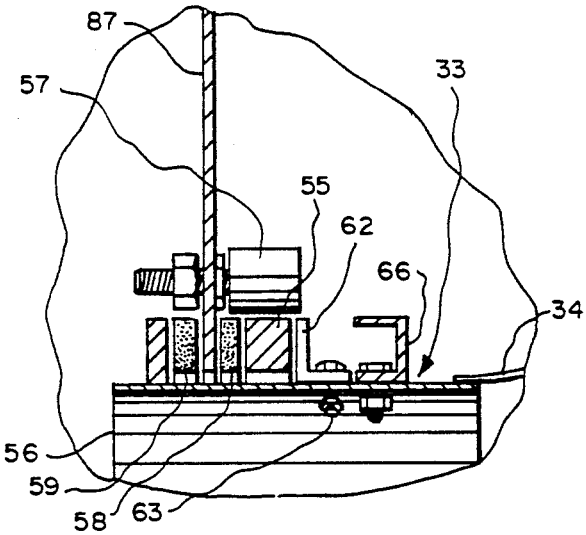
Figure 23:
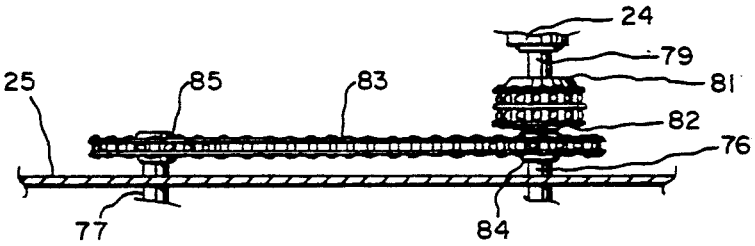

If desired, a circumferential seal 99 could be provided between air supply tube 88 and air inlet tube 86. (FIG. 24) Or, a drying air input assembly similar to that shown in FIGS. 10 and 13 could be installed on rear drum closure 87, providing the rotating seals 58 and 59 as described hereinabove. (FIG. 25)

Although the drying air inlet aspirating arrangement is illustrated and described as having the drying air supply tube 88 telescoped into air inlet tube 86, the aspirating action could be provided with other relative positioning of these tubes. For example, the end of tube 88 could be placed outside but near to the inlet of tube 86 to provide the aspirating action. Or, air supply tube 88 could be extended completely through air inlet tube 86 to protrude slightly beyond into the interior of drum 20. Comparable aspirating action would occur in this event. Also, a simple opening through rear drum closure 88 could also be utilized. The outlet end of air supply tube 88 would then be positioned into said opening, or slightly outward therefrom, or slightly inward therefrom.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. An apparatus for drying brine shrimp cysts for storage, said apparatus comprising:

a generally closed drum having a longitudinally axis with a substantial horizontal components, and a front end and a rearward end, and being supported to be rotated about said axis, at least a portion of the drum comprising an air permeable, cyst retaining fine mesh screen, the remainder of the drum being impermeable to air;

means for admitting a flow of cyst drying air into the interior of the rotating drum;

sealable removable access means for placing and removing cysts into and from the drum; and means rotating the drum about said axis; so that the drying air flows in its entirety from the rotating drum through at least a portion of the screen; wherein the drying air admitting means comprises;

a drying air admitting central opening directly into the interior of the drum through the rearward end thereof; and a stationary drying air supply tube coaxial with the drum with an outlet end dimensioned and positioned with respect to said central opening to cause ambient air to be drawn into the interior of the drum by a flow of drying air provided through said air supply tube into the interior of the drum.

2. The apparatus of claim 1, wherein:

the drying air admitting central opening comprises an open-ended, elongate tube secured to rotate coaxially with the drum; and the outlet end of the drying air supply tube is stationary and telescoped within the air admitting tube.

3. The apparatus of claim 1, wherein the means rotating the drum comprises:

roller means supporting the drum to be rotatable thereon about its longitudinal axis; and means applying power to the drum causing it to rotate about its longitudinal axis upon the roller means.

4. The apparatus of claim 2, wherein the means rotating the drum comprises:

roller means supporting the drum to be rotatable about its longitudinal axis; and means applying power to rotate the roller means, so that the drum is rotated by said roller means.

5. The apparatus of claim 3, wherein the air admitting means comprises:

a drying air admitting central opening in the rearward end of the drum; and a stationary drying air supply tube coaxial with the drum, with an outlet end dimensioned and positioned with respect to said central opening to cause ambient air to be drawn into the interior of the drum by a flow of drying air provided through said air supply tube into the interior of the drum.

6. The apparatus of claim 4, wherein the air admitting means comprises:

a drying air admitting central opening in the rearward end of the drum; and a stationary drying air supply tube coaxial with the drum, with an outlet end dimensioned and positioned with respect to said central opening to cause ambient air to be drawn into the interior of the drum by a flow of drying air provided through said air supply tube into the interior of the drum.

7. The apparatus of claim 3, wherein the air admitting means comprises:

a drying air admitting central opening in the rearward end of the drum;

a stationary drying air supply tube coaxial with the drum, dimensioned and positioned with respect to said central opening to cause ambient air to be drawn into the interior of the drum by the flow of drying air provided through said air supply tube into the interior of the drum;

the drying air admitting central opening comprises an open-ended elongate tube having a longitudinal axis coincident with that of the drum and secured to rotate therewith; and the outlet end of the drying air supply tube is telescoped within said air admitting tube.

8. The apparatus of claim 4, wherein the air admitting means comprises:

a drying air admitting central opening in the rearward end of the drum;

a stationary drying air supply tube coaxial with the drum, with an outlet end dimensioned and positioned with respect to said central opening to cause ambient air to be drawn into the interior of the drum by the flow of drying air provided through said air supply tube into the interior of the drum; therein the drying air admitting central opening comprises an open-ended elongate tube having a longitudinal axis coincident with that of the drum and secured to rotate therewith; and the outlet end of the drying air supply tube is telescoped within said air admitting tube.

9. The apparatus of claim 7, wherein the drum access means comprises:

an opening in the front end of the drum;

a plate for closing said opening; and releasable clamping means securing the plate in position closing the opening.

10. The apparatus of claim 8, wherein the drum access means comprises:

an opening in the front end of the drum;

a plate for closing said opening; and releasable clamping means securing the plate in position closing the opening.

11. The apparatus of claim 1, wherein the drying air admitting means comprises:

a drying air admitting central opening in the rearward end of the drum rotating therewith;

a drying air supply tube with a stationary outlet end communicating with said opening; and a seal acting between said outlet end and the drum.

12. The apparatus of claim 1, wherein the rearward end of the drum comprises a plate, and the drying air admitting means comprises:

a drying air inlet tube coaxial with the drum and extending through said plate and supported separately from the drum to remain stationary as the drum is rotated;

air inlet tube supporting bearing wheels carried by said plate;

a raceway installed about the outside circumference of the air inlet tube to bear upon the wheels; and seal means acting between said plate and the air inlet tube, comprising a pair of annular seal members each installed in sealing contact with the outside surface of the tube and one of the faces of the plate, and a seal retaining flange affixed to the tube near its drum end, one of the seal means being retained between the plate and the raceway and the other between the plate and the flange.

13. The apparatus of claim 1, further comprising:

a stationary housing substantially enclosing at least the air permeable portion of the drum and having vent means directing the returning flow of drying, air to the atmosphere.

14. The apparatus of claim 7, further comprising:

a stationary housing substantially enclosing at least the air permeable portion of the drum and having vent means directing ,the returning flow of drying air to the atmosphere.

15. The apparatus of claim 12, further comprising:

a stationary housing substantially enclosing at least the air permeable portion of the drum and having vent means directing the returning flow of drying air to the atmosphere.

16. The apparatus of claim 2, wherein:

the air premeable portion of the drum comprises an outermost layer of perforated rigid material covered on its inside surface by the fine mesh screen.

17. The apparatus of claim 7, wherein:

the air permeable portion of the drum comprises an outermost layer of perforated rigid material covered on its inside surface by the fine mesh screen.

* * * * *